US006510888B1

(12) United States Patent
Matsumura et al.

(10) Patent No.: US 6,510,888 B1
(45) Date of Patent: Jan. 28, 2003

(54) SUBSTRATE SUPPORT AND METHOD OF FABRICATING THE SAME

(75) Inventors: Naomi Matsumura, Hirakatashi (JP); Masahiko Kowaka, Kobe (JP); William A. Bagley, San Jose, CA (US); Akira Terashi, Fuji (JP); Hideaki Kondo, Kumagaya (JP)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/921,104

(22) Filed: Aug. 1, 2001

(51) Int. Cl.[7] ..... B22D 19/04
(52) U.S. Cl. ..... 164/108; 164/76.1
(58) Field of Search ..... 164/97, 98, 108, 164/109, 110, 76.1

(56) References Cited

U.S. PATENT DOCUMENTS

| | | | | |
|---|---|---|---|---|
| 3,885,128 A | * | 5/1975 | Dills | 219/455.12 |
| 4,572,270 A | | 2/1986 | Funatani et al. | 164/97 |
| 5,293,923 A | | 3/1994 | Alabi | 164/102 |
| 5,456,757 A | | 10/1995 | Aruga et al. | 118/723 E |
| 5,509,459 A | | 4/1996 | Divecha et al. | 164/98 |
| 5,584,936 A | | 12/1996 | Pickering et al. | 118/728 |
| 5,851,298 A | | 12/1998 | Ishii | 118/728 |
| 5,998,767 A | | 12/1999 | Kersch et al. | 219/390 |
| 6,086,680 A | | 7/2000 | Foster et al. | 118/725 |
| 6,160,244 A | | 12/2000 | Ohashi | 219/444.1 |
| 6,190,113 B1 | | 2/2001 | Bui et al. | 414/672 |

* cited by examiner

*Primary Examiner*—Kuang Y. Lin
(74) *Attorney, Agent, or Firm*—Moser, Patterson & Sheridan LLP

(57) ABSTRACT

A substrate support and method of fabricating the same are provided. Generally, one method of fabrication includes assembling a subassembly comprising a first reinforcing member and a heating element, supporting the subassembly at least 40mm from a bottom of a mold, encapsulating the supported subassembly with molten aluminum, and applying pressure to the molten aluminum. Alternatively, a method of fabrication includes assembling a subassembly comprising a stud disposed through a heating element sandwiched between a first reinforcing member and a second reinforcing member, supporting the subassembly above a bottom of a mold, encapsulating the subassembly disposed in the mold with molten aluminum to form a casting, forming a hole in the casting by removing at least a portion of the stud, and disposing a plug in at least a portion of the hole.

20 Claims, 5 Drawing Sheets

SUBSTRATE SUPPORT AND METHOD OF FABRICATING THE SAME

BACKGROUND OF THE DISCLOSURE

1. Field of the Invention

Embodiments of the invention generally provide a substrate support utilized in semiconductor processing and a method of fabricating the same.

2. Description of the Background Art

Liquid crystal displays or flat panels are commonly used for active matrix displays such as computer and television monitors. Generally, flat panels comprise two glass plates having a layer of liquid crystal material sandwiched therebetween. At least one of the glass plates includes at least one conductive film disposed thereon that is coupled to a power supply. Power supplied to the conductive film from the power supply changes the orientation of the crystal material, creating a pattern such as text or graphics seen on the display. One fabrication process frequently used to produce flat panels is plasma enhanced chemical vapor deposition (PECVD).

Plasma enhanced chemical vapor deposition is generally employed to deposit thin films on a substrate such as a flat panel or semiconductor wafer. Plasma enhanced chemical vapor deposition is generally accomplished by introducing a precursor gas into a vacuum chamber that contains a substrate. The precursor gas is typically directed through a distribution plate situated near the top of the chamber. The precursor gas in the chamber is energized (e.g., excited) into a plasma by applying RF power to the chamber from one or more RF sources coupled to the chamber. The excited gas reacts to form a layer of material on a surface of the substrate that is positioned on a temperature controlled substrate support. In applications where the substrate receives a layer of low temperature polysilicon, the substrate support may be heated in excess of 400 degrees Celsius. Volatile by-products produced during the reaction are pumped from the chamber through an exhaust system.

Generally, the substrate support utilized to process flat panel displays are large, often exceeding 550 mm×650 mm. The substrate supports for high temperature use typically are casted, encapsulating one or more heating elements and thermocouples in an aluminum body. Due to the size of the substrate support, one or more reinforcing members are generally disposed within the substrate support to improve the substrate support's stiffness and performance at elevated operating temperatures (i.e., in excess of 350 degrees Celsius and approaching 500 degrees Celsius). Although substrate supports configured in this manner have demonstrated good processing performance, manufacturing supports has proven difficult.

One problem in providing a robust substrate support is that the reinforcing member may occasionally displace, deform and sometimes break during the casting process. The reinforcing member typically includes portions that are unsupported in the pre-cast state of the substrate support. After assembling the reinforcing member, the heating elements and thermocouples into a subassembly, the subassembly is supported in a mold and encapsulated with molten aluminum. Conventional presses used in the casting process typically have one or twin rams that provide up to about 500 tons of pressure that works not whole area of cast surface but local area flowing the molten aluminum around the subassembly disposed in the substrate support mold. In this case, there is always nonuniformity of pressure working on the molten aluminum. Occasionally, this nonuniformity of the weight and pressure of the aluminum flowing in the mold during the casting process causes the reinforcing member to displacement, deformation and sometimes fracture. Additionally, this casting process results in undesirable heterogeneous grain size of aluminum cast. Furthermore, such pressures stress the substrate support up to about 28 MPa, which is not enough to get a desired uniform micro-grain size within the aluminum cast.

Another problem with substrate support formed using this molding process is the lack of integrity of the aluminum where the flow of molten aluminum comes back together on the side of the substrate support furthest from the molten aluminum source. As a substantial amount of aluminum and time is needed to encapsulate the heating elements, thermocouples and reinforcing members, the flow of aluminum may cool causing a seam to be created where the leading edges of the aluminum flow merges under the subassembly at less than acceptable temperatures.

Depending on the temperature of the aluminum when the seam is formed, the seam may become a source of a variety of defects. For example, vacuum leaks may propagate through the seam between the interior of the chamber and the environment surrounding the chamber. Vacuum leakage may degrade process performance and may lead to poor heater performance that contributes to pre-mature heater failure. Moreover, thermal cycling of the substrate support may cause the substrate support to fracture along the seam, thereby causing failure and possible release of particulates into the chamber environment.

As the cost of materials and manufacturing the substrate support is great, failure of the substrate support is highly undesirable. Additionally, if the substrate support fails during processing, a substrate supported thereon may be damaged. This can occur after a substantial number of processing steps have been preformed thereon, thus resulting in the expensive loss of the substrate support. Moreover, replacing a damaged support in the process chamber creates a costly loss of substrate throughput while the process chamber is idled during replacement or repair of the substrate support. Moreover, as the size of the next generation substrate supports are increased to accommodate substrates in excess of 1.44 square meters at operating temperatures approaching 500 degrees Celsius, the aforementioned problems become increasingly important to resolve.

Therefore, there is a need for an improved substrate support.

SUMMARY OF THE INVENTION

Generally, a substrate support and method of fabricating the same are provided. In one embodiment, a method of fabricating a substrate support includes the steps of assembling a subassembly comprising a first reinforcing member and a heating element, supporting the subassembly at least 40mm from a bottom of a mold, encapsulating the supported subassembly with molten aluminum, and applying pressure to the molten aluminum.

In another embodiment, a method of fabricating a substrate support includes the steps of a method of fabrication includes assembling a subassembly comprising a stud disposed through a heating element sandwiched between a first reinforcing member and a second reinforcing member, supporting the subassembly above a bottom of a mold, encapsulating the subassembly disposed in the mold with molten aluminum to form a casting, forming a hole in the casting by removing at least a portion of the stud, and disposing a plug in at least a portion of the hole.

In another aspect of the invention, a substrate support is provided. In one embodiment, the substrate support includes at least a first reinforcing member and a heating element disposed within a cast aluminum body. At least one hole is formed in the aluminum body between an outer surface and at least the heating element or the reinforcing member. A plug is disposed in the hole between the outer surface and the heating element or the reinforcing member. In another embodiment, the hole houses a stud during casting that maintains the heating element and the reinforcing member in a spaced-apart relation and is at least partially removed from the hole before insertion of the plug.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

The invention generally provides a substrate support and methods of fabricating a substrate support. The invention is illustratively described below in reference to a plasma enhanced chemical vapor deposition system, such as a plasma enhanced chemical vapor deposition (PECVD) system, available from AKT, a division of Applied Materials, Inc., Santa Clara, Calif. However, it should be understood that the invention has utility in other system configurations such as physical vapor deposition systems, ion implant systems, etch systems, other chemical vapor deposition systems and any other system in which processing a substrate on a substrate support is desired.

Figure 1:
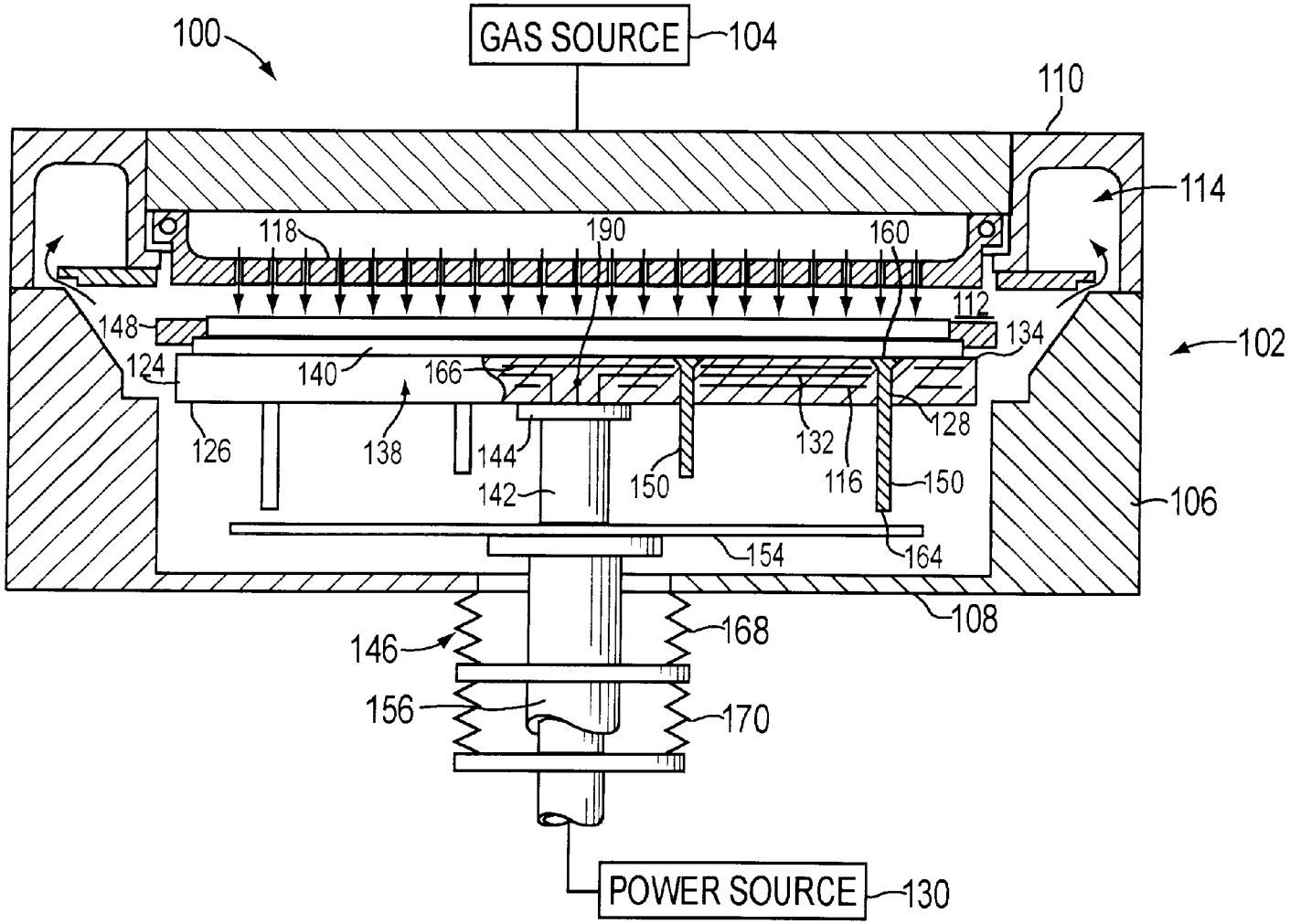
FIG. 1 depicts a schematic sectional view of one embodiment of a processing chamber having a substrate support of the present invention.

FIG. 1 is a cross sectional view of one embodiment of a plasma enhanced chemical vapor deposition system 100. The system 100 generally includes a chamber 102 coupled to a gas source 104. The chamber 102 has walls 106, a bottom 108 and a lid assembly 110 that define a process volume 112. The process volume 112 is typically accessed through a port (not shown) in the walls 106 that facilitates movement of the substrate 140 into and out of the chamber 102. The walls 106 and bottom 108 are typically fabricated from a unitary block of aluminum or other material compatible for processing. The lid assembly 110 contains a pumping plenum 114 that couples the process volume 112 to an exhaust port (that includes various pumping components, not shown).

The lid assembly 110 is supported by the walls 106 and can be removed to service the chamber 102. The lid assembly 110 is generally comprised of aluminum. A distribution plate 118 is coupled to an interior side 120 of the lid assembly 110. The distribution plate 118 is typically fabricated from aluminum. The center section includes a perforated area through which process and other gases supplied from the gas source 104 are delivered to the process volume 112. The perforated area of the distribution plate 118 is configured to provide uniform distribution of gases passing through the distribution plate 118 into the chamber 102.

A heated substrate support assembly 138 is centrally disposed within the chamber 102. The support assembly 138 supports a substrate 140 during processing. In one embodiment, the substrate support assembly 138 comprises an aluminum body 124 that encapsulates at least one embedded heating element 132 and a thermocouple 190. At least a first reinforcing member 116 is generally embedded in the body 124 proximate the heating element 132. A second reinforcing member 166 may be disposed within the body 124 on the side of the heating element 132 opposite the first reinforcing member 116. The reinforcing members 116 and 166 may be comprised of metal, ceramic or other stiffening materials. In one embodiment, the reinforcing members 116 and 166 are comprised of aluminum oxide fibers. Alternatively, the reinforcing members 116 and 166 may be comprised of aluminum oxide fiber combined with aluminum oxide particles, silicon carbide fiber, silicon oxide fiber or similar materials. The reinforcing members 116 and 166 may include loose material or may be a pre-fabricated shape such as a plate. Alternatively, the reinforcing members 116 and 166 may comprise other shapes and geometry. Generally, the reinforcing members 116 and 166 have some porosity that allows aluminum to impregnate the members 116, 166 during a casting process described below.

The heating element 132, such as an electrode disposed in the support assembly 138, is coupled to a power source 130 and controllably heats the support assembly 138 and substrate 140 positioned thereon to a predetermined temperature. Typically, the heating element 132 maintains the substrate 140 at a uniform temperature of about 150 to at least about 460 degrees Celsius.

Generally, the support assembly 138 has a lower side 126 and an upper side 134 that supports the substrate. The lower side 126 has a stem cover 144 coupled thereto. The stem cover 144 generally is an aluminum ring coupled to the support assembly 138 that provides a mounting surface for the attachment of a stem 142 thereto.

Generally, the stem 142 extends from the stem cover 144 and couples the support assembly 138 to a lift system (not shown) that moves the support assembly 138 between an elevated position (as shown) and a lowered position. A bellows 146 provides a vacuum seal between the chamber volume 112 and the atmosphere outside the chamber 102 while facilitating the movement of the support assembly 138. The stem 142 additionally provides a conduit for electrical and thermocouple leads between the support assembly 138 and other components of the system 100.

The support assembly 138 generally is grounded such that RF power supplied by a power source 122 to the distribution plate 118 (or other electrode positioned within or near the lid assembly of the chamber) may excite the gases disposed in the process volume 112 between the support assembly 138 and the distribution plate 118. The RF power from the power source 122 is generally selected commensurate with the size of the substrate to drive the chemical vapor deposition process.

The support assembly 138 additionally supports a circumscribing shadow frame 148. Generally, the shadow frame 148 prevents deposition at the edge of the substrate 140 and support assembly 138 so that the substrate does not stick to the support assembly 138.

The support assembly 138 has a plurality of holes 128 disposed therethrough that accept a plurality of lift pins 150. The lift pins 150 are typically comprised of ceramic or anodized aluminum. Generally, the lift pins 150 have first ends 160 that are substantially flush with or slightly recessed from a upper side 134 of the support assembly 138 when the lift pins 150 are in a normal position (i.e., retracted relative to the support assembly 138). The first ends 160 are generally flared to prevent the lift pins 150 from falling through the holes 128. Additionally, the lift pins 150 have a second end 164 that extends beyond the lower side 126 of the support assembly 138. The lift pins 150 may be actuated relative to the support assembly 138 by a lift plate 154 to project from the support surface 130, thereby placing the substrate in a spaced-apart relation to the support assembly 138.

The lift plate 154 is disposed proximate the lower side 126 of the support surface. The lift plate 154 is connected to the actuator by a collar 156 that circumscribes a portion of the stem 142. The bellows 146 includes an upper portion 168 and a lower portion 170 that allow the stem 142 and collar 156 to move independently while maintaining the isolation of the process volume 112 from the environment exterior to the chamber 102. Generally, the lift plate 154 is actuated to cause the lift pins 150 to extend from the upper side 134 as the support assembly 138 and the lift plate 154 move closer together relative to one another.

Figure 2:
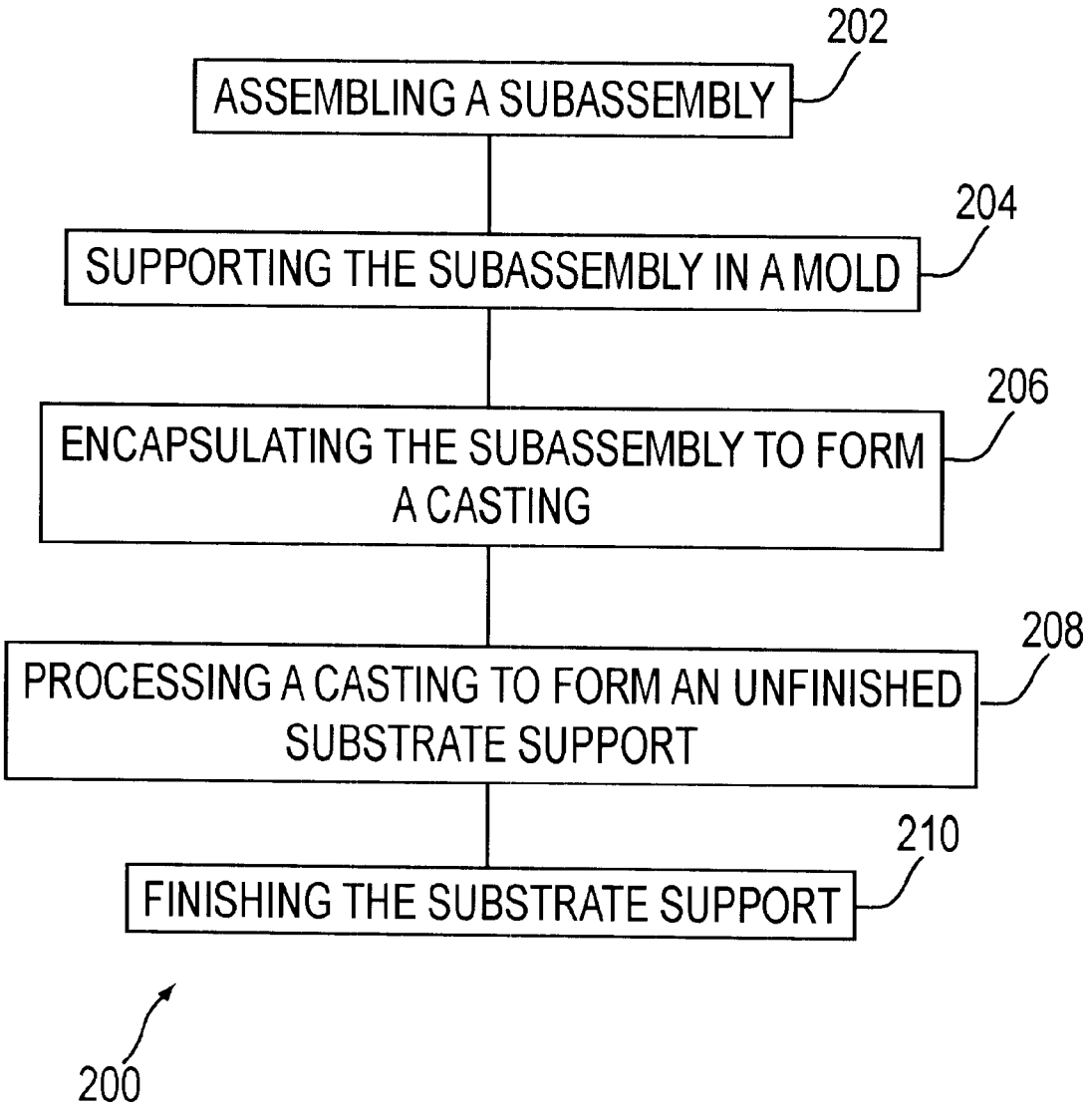
FIG. 2 is one embodiment of a method of fabricating a substrate support.

FIG. 2 depicts a flow chart of one embodiment of a method 200 for fabricating the support assembly 138. Generally, the method 200 begins at step 202 of assembling a subassembly that includes the reinforcing members 116, 166, the heating element 132 and the thermocouple 190. At step 204 and step 206, the subassembly 300 is supported in a mold that is disposed in a press and respectively encapsulated with aluminum to form a casting. At step 208, the casting is processed to form an unfinished substrate support. At step 210, the unfinished substrate support is finished by anodizing the substrate support assembly 138 and coupling the heating elements 132 to the appropriate electrical connections, for example, soldering lead wires to the heating elements 132.

A depicts one embodiment of a subassembly 300 assembled at step 202. The subassembly 300 generally includes the first reinforcing member 116, the second reinforcing member 166, the heating element 132 and the thermocouple 190. A plurality of studs 302, for example, fasteners, pins, rods, bolts and the like comprised of a ceramic or metallic material such as stainless steel, are utilized to support and maintain a predetermined spacing between the reinforcing members 116, 166, the heating element 132 and the thermocouple 190. The studs 302 vary in number and be arranged in different patterns, for example, a grid comprising 12 equally spaced studs 302 (see FIG. 3B). The studs 302 generally are passed through the first reinforcing member 116 and configured to support the first reinforcing member 116 at least 40 mm from an end 304 of the stud 302. In one embodiment, the position of the first reinforcing member 116 relative to the end 304 of the studs 302 is maintained by providing a first ledge 306 in the stud 302 on which the first reinforcing member 116 rests. Optionally, the stud 302 may incorporate other features or devices such as standoffs, threads, tapers and the like to maintain the relative positions of the studs 302 and the first reinforcing member 116.

The heating elements 132 and the thermocouples 190 are disposed on the studs 302 proximate the first reinforcing member 116 from the side of the stud 302 opposite the end 304. The heating elements 132 and the thermocouple 190 are generally disposed against the first reinforcing member 116 but may be maintained in a spaced-apart relation to the first reinforcing member 116. In one embodiment, a spaced-apart relation is maintained by resting the heating elements 132 and the thermocouple 190 on a second ledge 308 of the stud 302. Alternatively, threads, standoffs, spacers or geometry such as bosses incorporated into one or both of the heating elements 132, the thermocouple 190 and first reinforcing member 116 may be used to maintain the relative spacing therebetween.

The second reinforcing member 166 is disposed on the stud 302 proximate the heating element 132. Generally, the second reinforcing member 166 is disposed against the heating element 132 but may optionally be maintained in a spaced-apart relation by providing a third ledge 310 on which the second reinforcing member 166 rests. The spacing between the heating elements 132 and the second reinforcing member 166 may alternatively be maintained as described above.

The subassembly 300 may optionally be secured to prevent movement between the first reinforcing member 116, the second reinforcing member 166, the heating element 132 and the thermocouple 190 during casting. In one embodiment, the first reinforcing member 116 is retained against the first ledge 306 by a metallic collar 312 pressed on at least some of the studs 302. The second reinforcing member 166 is retained against the third ledge by another collar 312 while the heating element 132 and the thermocouple 190 are respectively retained against the second ledge 308 by another collar 312. The collars 312 are preferably fabricated from stainless steel. Alternatively, the subassembly 300 may be secured on the studs 302 by other devices such as nuts (with threaded studs), adhesives, friction on the studs (i.e., press or snap fit), wire, ceramic string, twine and the like. Optionally, the first reinforcing member 116, the second reinforcing member 166, the heating element 132 and the thermocouple 190 may include interlocking geometry integral to the subassembly such as mating pins and bosses, standoffs, press and snap fits and the like.

Optionally, the studs 302 may be coupled at their end 304 to a base plate 314. The base plate 314 is typically comprised of a metallic material and is utilized to position the subassembly 300 in a predetermined position in the mold 400. In one embodiment, the base plate 314 is a perforated steel plate having a plurality of threaded holes to accept the studs 302. The thickness of base plate 314 is at least 40 mm to prevent a deformation during the casting.

Figure 4:
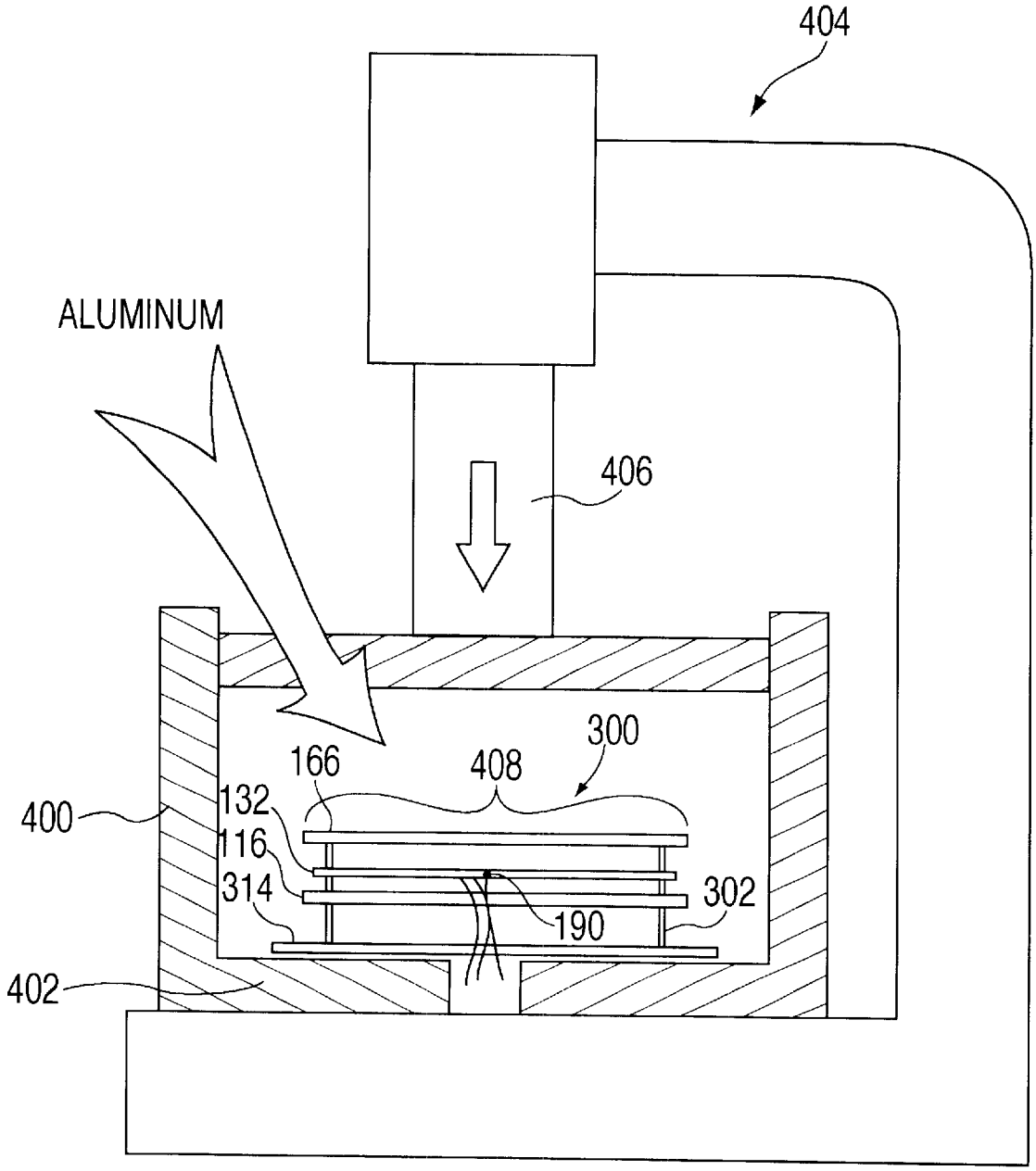
FIG. 4 is a schematic of the subassembly of FIG. 3A disposed in a press.

FIG. 4 depicts a schematic of one embodiment of the subassembly 300 disposed in the mold 400 which is disposed in the press 404. Generally, the subassembly 300 is positioned within the mold 400 such that the subassembly is supported from a bottom 402 of the mold 400 by at least 40 mm at step 204. The back plate 314 that is coupled to the subassembly 300 typically rests in a predetermined bottom 402 of the mold 400. The back plate 314 may be located relative the mold 400 in the predetermined position by dowel pins, geometric interfacing and the like. By maintaining the subassembly 300 in this position, adequate encapsulation around all sides of the subassembly 300 is ensured.

Alternatively, the subassembly 300 may be supported in the mold 400 in other ways. For example, mold pins (not shown) may project from the bottom 402 of the mold 400 and support the subassembly 300. In another configuration, one or more members (not shown) may extend between other portions of the mold 400 to support the subassembly 300. The studs 302 may be directly disposed on or in locating holes in mold bottom 402 while maintaining at least 40 mm between the first reinforcing plate 116 and the mold bottom 402 on subassemblies 300 that do not include the back plate 314.

The mold 400 is generally heated to minimize the cooling of the molten aluminum used to encapsulate the subassembly. The mold 400 may be heated through any conventional means including circulated fluids, resistance heaters and burners. Generally, the mold 400 is heated to a temperature between about 300 and about 350 degrees Celsius.

The molten aluminum at about 800 to about 900 degrees Celsius is generally dispensed into the mold in a single shot at step 206. The single shot minimizes seam formation at the interface between shots due to cooling of the aluminum that occurs during utilizing conventional processes. The aluminum may be dispensed manually or automatically through an opening in the top of the mold or one or more other passages (not shown). Generally, aluminum alloy 6061 is utilized but other alloys may be substituted.

Once the molten aluminum is in the mold, pressure is applied to the aluminum to assist the aluminum in flowing around and in between the components of the subassembly 300. The applied pressure additionally impregnates the reinforcing members 116 and 166 with aluminum. In one embodiment, a single ram 406 of the press 404 applies pressure to an area 408 of the molten aluminum above the subassembly 300. Generally, the area 408 is at least as large as the area of the subassembly 300 and may include the entire width of the mold 400. The pressure applied by the ram 406 is generally less than about 3,000 tons. The space between the support assembly 138 and the bottom 402 of the mold 400 or the base plate 314 enhances the flow the aluminum therebetween. Optionally, the mold 400 may include a vacuum applied to the mold's vents (not shown) to assist the flow of aluminum. The use of a single ram 406 over a large area 408 results in uniformity application of stress, preferably in excess of about 40 MPa, to the entire area of the support assembly 138, which eliminates the displacement, deformation and fracture of the reinforcing members 116, 166. The high stress correspondingly increases the homogeneity of grain size of aluminum cast and decreases the integrity of any seams or flow lines that may form during casting.

Figure 5:
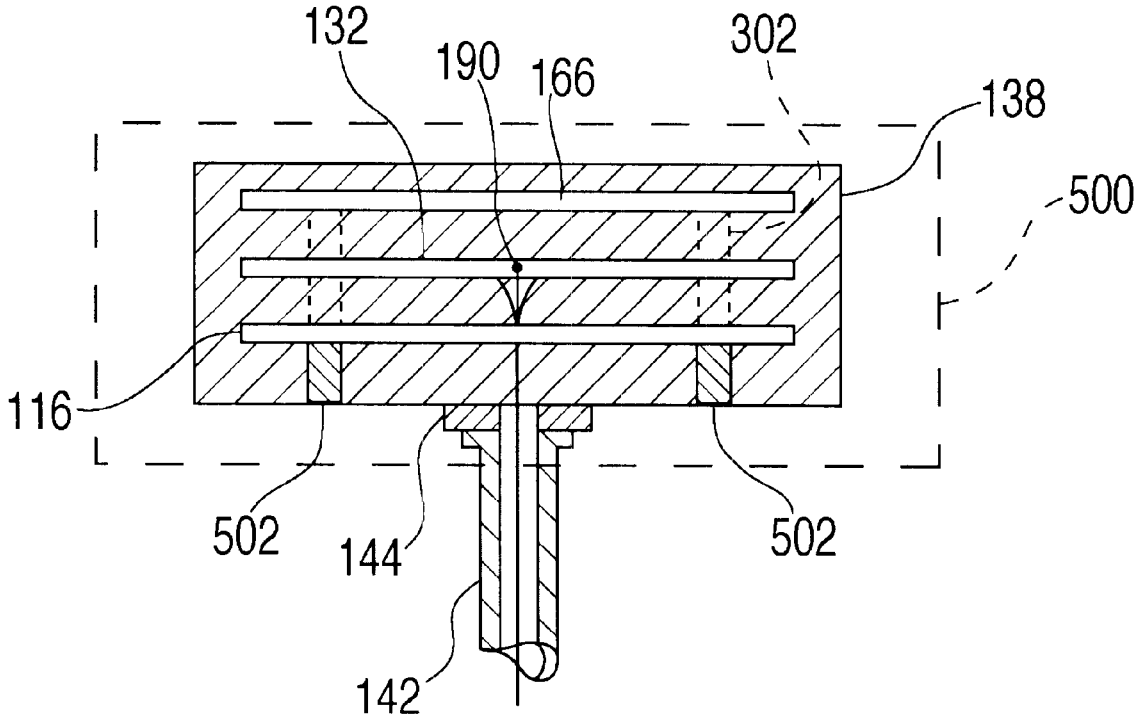
FIG. 5 is a sectional view of an embodiment of a substrate support.

FIG. 5 depicts one embodiment of the substrate support assembly 138 in the form of a post-molding casting 500. Generally, the casting 500 is processed at steps 206 to form an unfinished processing support. In one embodiment, the processing step 208 generally includes annealing the casting 500 to relieve residual stresses in the casting 500. In one embodiment, the casting 500 is annealed at about 510 to about 520 degrees Celsius for about 2 to about 3 hours.

Next, the casting is machined to roughly the dimensions of the finished substrate support assembly 138. The studs 302 are at least partially removed from the bottom side and replaced with an aluminum plug 502 that is welded to the substrate support assembly 138. The stem cover 144 is then welded to the substrate support assembly 138. The support assembly 138 is annealed once more before a final machining step that brings the substrate support 138 to its final dimensions. Electrical leads are then attached to the heating element 132 and fed through the stem 142 which is then welded to the stem cover 144.

The surface of the support assembly 138 is then treated to remove tool marks left by the machining operations. The step of removing the tool marks may optionally be completely or partially performed before the second anneal step. The surface treatments may include grinding, electropolishing, abrasive or bead blasting, chemical etching and the like. In one embodiment, the substrate support is treated by blasting the substrate support with aluminum oxide balls and exposing the support to an alkaline or acid etchant. At step 210, the substrate support 138 is anodized to provide a protective finish to the substrate support.

Although several preferred embodiments which incorporate the teachings of the present invention have been shown and described in detail, those skilled in the art can readily devise many other varied embodiments that still incorporate these teachings.

What is claimed is:

1. A method of fabricating a substrate support comprising:

disposing a first reinforcing member and a heating element on a stud to form a subassembly;

encapsulating the subassembly in a mold with molten aluminum to form a casting; and finishing the casting by removing at least a portion of the stud.

2. The method of claim 1, wherein the disposing step further comprises:

sandwiching the heater element between the first reinforcing member and a second reinforcing member; and coupling a backplate to the second reinforcing member and having at least 40 $\mu$m spacing therebetween.

3. The method of claim 1, wherein the disposing step further comprises:

sandwiching the heater element between the first reinforcing member and a second reinforcing member.

4. The method of claim 3, wherein the encapsulation step further comprises:

impregnating the first reinforcing member and the second reinforcing member with aluminum.

5. The method of claim 1, wherein the encapsulating step further comprises:

supporting the subassembly at least 40 mm from a bottom of the mold or a backplate coupled to the subassembly; and applying pressure to the molten aluminum.

6. The method of claim 1, wherein the applying step further comprises:

applying pressure to the molten aluminum to an area of the molten aluminum at least directly above the subassembly.

7. The method of claim 1, wherein the encapsulation step further comprises:

impregnating the first reinforcing member with aluminum.

8. The method of claim 1, wherein the encapsulating step further comprises:

providing the entire amount of molten aluminum into the mold in one shot.

9. The method of claim 1, wherein the finishing step further comprises:

annealing the casting;

removing aluminum from at least a portion of the casting to form an unfinished support; and anodizing the unfinished support.

10. The method of claim 1, wherein the finishing step further comprises:

filling a void left in the aluminum by the removed portion of the stud with an aluminum plug.

11. The method of claim 1, wherein the first reinforcing member is comprised of metal or ceramic.

12. The method of claim 1 wherein the first reinforcing member is comprised of a ceramic material selected from the group consisting of aluminum oxide plate, aluminum oxide fiber and aluminum oxide particle combined with silicon oxide fiber, silicon oxide particle, silicon carbide fiber or silicon carbide particle.

13. A method of fabricating a substrate support comprising:

assembling a subassembly comprising a stud disposed through a heating element sandwiched between a first reinforcing member and a second reinforcing member;

supporting the subassembly above a bottom of a mold;

encapsulating the subassembly in the mold with molten aluminum for form a casting;

forming a hole in the casting by removing at least a portion of the stud; and disposing a plug in at least a portion of the hole.

14. The method of claim 13, wherein the step of assembling the subassembly further comprises coupling a backplate to the subassembly in a spaced-apart relation of at least 40 mm.

15. A method of fabricating a substrate support comprising:

assembling a subassembly comprising a heating element held between a first reinforcing member and a second reinforcing member by a plurality of studs;

coupling a backplate to the subassembly in a spaced-apart relation of at least 40 mm;

casting the subassembly supported in a mold with molten aluminum in one shot;

applying pressure to the molten aluminum; and removing at least a portion of the stud surrounding the casted subassembly.

16. The method of claim 15 further comprising:

applying a pressure of at least 40 MPa to the molten aluminum over an area of the molten aluminum at least directly above the subassembly.

17. The method of claim 15 further comprises heating the mold to between about 350 and about 400 degrees Celsius.

18. The method of claim 15 further comprising filling voids left in the aluminum by the removed portion of the studs with an aluminum plug.

19. The method of claim 15, wherein the step of applying pressure further comprises impregnating the first reinforcing member and second reinforcing members with aluminum.

20. The method of claim 15 further comprising anodizing the substrate support.

* * * * *

UNITED STATES PATENT AND TRADEMARK OFFICE

CERTIFICATE OF CORRECTION

PATENT NO. : 6,510,888 B1
APPLICATION NO. : 09/921104
DATED : January 28, 2003
INVENTOR(S) : Matsumura et al.

Figure 3A:
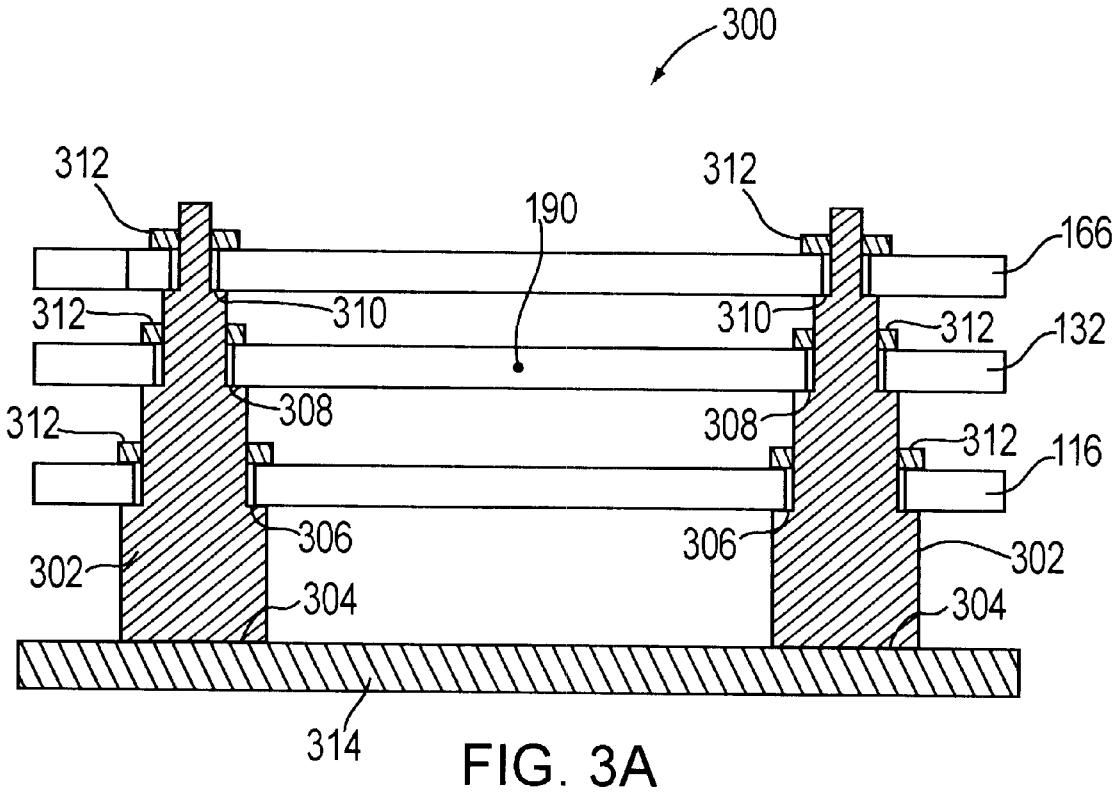
FIG. 3A is a sectional view of one embodiment of a subassembly.
Figure 3B:
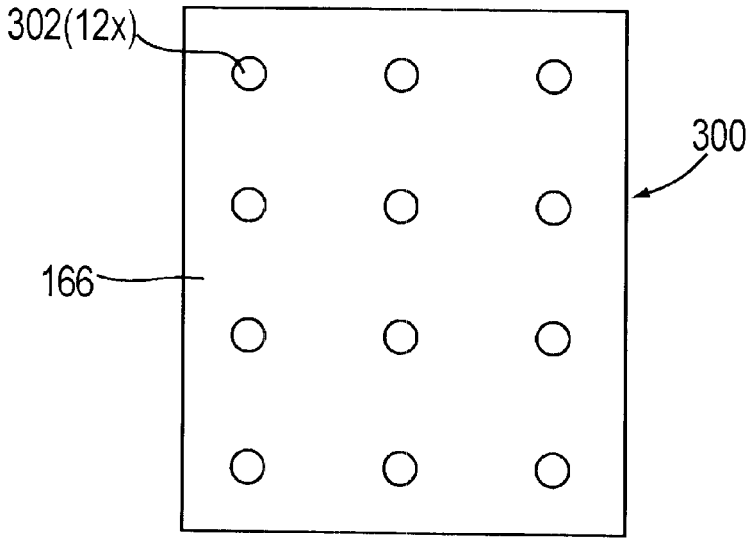
FIG. 3B is a plan view of the subassembly of FIG. 3A.

It is certified that error appears in the above-identified patent and that said Letters Patent is hereby corrected as shown below:

Column 5
Line 43, before "A", please insert --Fig. 3--.
Line 53, please insert --can--, after "and".

Column 8
Line 29, please change "40 $\mu$m" to --40mm--.

Signed and Sealed this

Twenty-first Day of August, 2007

JON W. DUDAS
*Director of the United States Patent and Trademark Office*